US007804284B1

(12) United States Patent
Wong

(10) Patent No.: US 7,804,284 B1
(45) Date of Patent: Sep. 28, 2010

(54) PSRR REGULATOR WITH OUTPUT POWERED REFERENCE

(75) Inventor: Kern Wai Wong, Sunnyvale, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 448 days.

(21) Appl. No.: 11/871,518

(22) Filed: Oct. 12, 2007

(51) Int. Cl.
*G05F 1/59* (2006.01)

(52) U.S. Cl. ..... 323/269; 323/281

(58) Field of Classification Search ..... 323/268, 323/269, 272, 281, 282
See application file for complete search history.

(56) References Cited

U.S. PATENT DOCUMENTS

| | | | | |
|---|---|---|---|---|
| 5,781,000 | A * | 7/1998 | Saeki et al. | 323/234 |
| 6,114,845 | A | 9/2000 | Capici et al. | |
| 6,278,320 | B1 | 8/2001 | Vu | |
| 6,498,469 | B2 | 12/2002 | Kobayashi et al. | |
| 6,542,027 | B2 | 4/2003 | Zha et al. | |
| 6,724,176 | B1 | 4/2004 | Wong et al. | |
| 7,129,686 | B1 | 10/2006 | Huang et al. | |
| 7,173,377 | B2 * | 2/2007 | Park et al. | 315/169.1 |
| 7,276,885 | B1 * | 10/2007 | Tagare | 323/267 |
| 2006/0108992 | A1 * | 5/2006 | Pruvost et al. | 323/281 |
| 2007/0120544 | A1 * | 5/2007 | Ritter | 323/281 |
| 2009/0153124 | A1 * | 6/2009 | Ishii | 323/290 |
| 2009/0237055 | A1 * | 9/2009 | Sakai et al. | 323/284 |
| 2009/0322302 | A1 * | 12/2009 | Fukushi | 323/284 |

OTHER PUBLICATIONS

The Best of Bob Pease—The Design and Band-Gap Reference Circuits: Trials and Tribulations, http:www.national.com/rap/Application/0,1570,24,00.html, accessed Sep. 12, 2007, 6 pgs.

Tham, Khong-Meng et al., "A Low Supply Voltage Hish PSRR Voltage Reference in CMOS Process," IEEE Journal of Solid-State Circuits, vol. 30, No. 5, May 1995, pp. 586-590.

Chung, Wen-Yaw et al., "A Wide-Range and High PSRR CMOS Voltage Reference for Implantable Device," APCCAS 2006, pp. 482-485.

Du, Xiao et al., "A Curvature-Compensated Bandgap Reference with Improved PSRR," IEEE, 2005, pp. 548-551.

Hui, Shen et al., "A Precise Bandgap Reference with High PSRR," IEEE, 2005, pp. 267-270.

Mehrmanesh, S. et al., "A 1-Volt, High PSRR, CMOS Bandgap Voltage Reference," IEEE, 2003, pp. I-381-I-384.

Hu, Yamu et al., "A 900mV 25 mW High PSRR CMOS Voltage Reference Dedicated to Implantable Micro-Devices," IEEE, 2003, pp. I-373-I-376.

LP5900, Ultra Low Noise, 150 mA Linear Regulator for RF/Analog Circuits Requires No Bypass Capacitor, National Semiconductor Corporation, Sep. 2007, pp. 1-12.

(Continued)

*Primary Examiner*—Jeffrey L Sterrett
(74) *Attorney, Agent, or Firm*—Frommer Lawrence & Haug LLP; Matthew M. Gaffney

(57) ABSTRACT

The invention relates to a regulator with a reference generator circuit (e.g., a band-gap reference) and a reference generator power selector. The reference generator power selector selectively powers the reference generator circuit from an input power signal during start-up and from a regulated power signal during steady-state operation. The reference generator power selector may also select from multiple regulated power signals during steady-state operation.

20 Claims, 10 Drawing Sheets

OTHER PUBLICATIONS

LP3990, 150mA Linear Voltage Regulator for Digital Applications, National Semiconductor Corporation, Oct. 2005, pp. 1-13.
LP5952, 350mA Dual Rail Linear Regulator, National Semiconductor Corporation, Oct. 2007, pp. 1-16.
LP3907, Dual High-Current Step-Down DC/DC and Dual Linear Regulator with 12C Compatible Interface, National Semiconductor Corporation, Aug. 2007, pp. 1-42.
LP3906, Dual High-Current Step-Down DC/DC and Dual Linear Regulator with 12C Compatible Interface, National Semiconductor Corporation, Sep. 2007, pp. 1-40.
LP3971, Power Management Unit for Advanced Application Processors, National Semiconductor Corporation, Nov. 8, 2007, pp. 1-48.
Application and Figures for U.S. Appl. No. 11/871,536, filed Oct. 12, 2007, 18 pgs.

* cited by examiner

PSRR REGULATOR WITH OUTPUT POWERED REFERENCE

TECHNICAL FIELD

The invention is generally directed to the area of power regulation. The invention is directed, particularly, but not exclusively to improving the power supply rejection ratio of a regulator.

BACKGROUND

Regulators such as linear regulators and switching regulators are typically employed to provide a substantially constant output voltage or output current over a range of input voltages, input disturbances, output load changes, and/or the like. In particular, the ability of a regulator to provide a constant output in spite of input supply noise is commonly referred to as the power supply rejection ratio (PSRR). It is generally desirable for a regulator to have a high PSRR.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified. These drawings are not necessarily drawn to scale.

For a better understanding of the present invention, reference will be made to the following Detailed Description, which is to be read in association with the accompanying drawings, wherein.

DETAILED DESCRIPTION

Various embodiments of the present invention will be described in detail with reference to the drawings. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" includes plural reference. References in the singular are made merely for clarity of reading and include plural reference unless plural reference is specifically excluded. The meaning of either "in" or "on" includes both "in" and "on." The term "or" is an inclusive "or" operator, and is equivalent to the term "and/or" unless specifically indicated otherwise. The term "based on" or "based upon" is not exclusive and is equivalent to the term "based, at least in part, on" and includes being based on additional factors, some of which are not described herein. The term "coupled" means at least either a direct electrical connection between the items connected, or an indirect connection through one or more passive or active intermediary devices. The term "circuit" means at least either a single component or a multiplicity of components, either active and/or passive, that are coupled together to provide a desired function or functions. The term "signal" means at least one current, voltage, charge, temperature, data, or other signal. A "signal" may be used to communicate using active high, active low, time multiplexed, synchronous, asynchronous, differential, single-ended, or any other digital or analog signaling or modulation techniques. A "signal" may also be employed to provide and/or transmit power. Where either a field effect transistor (FET) or a bipolar transistor may be employed as an embodiment of a transistor, the scope of the words "gate", "drain", and "source" includes "base", "collector", and "emitter", respectively, and vice versa. The phrase "in one embodiment," as used herein does not necessarily refer to the same embodiment, although it may.

Briefly stated, the invention relates to a regulator with a reference generator circuit (e.g., a band-gap reference) and a reference generator power selector. The reference generator power selector selectively powers the reference generator circuit from an input power signal during start-up and from a regulated power signal during steady-state operation. The reference generator power selector may also select from multiple regulated power signals during steady-state operation.

Figure 1:
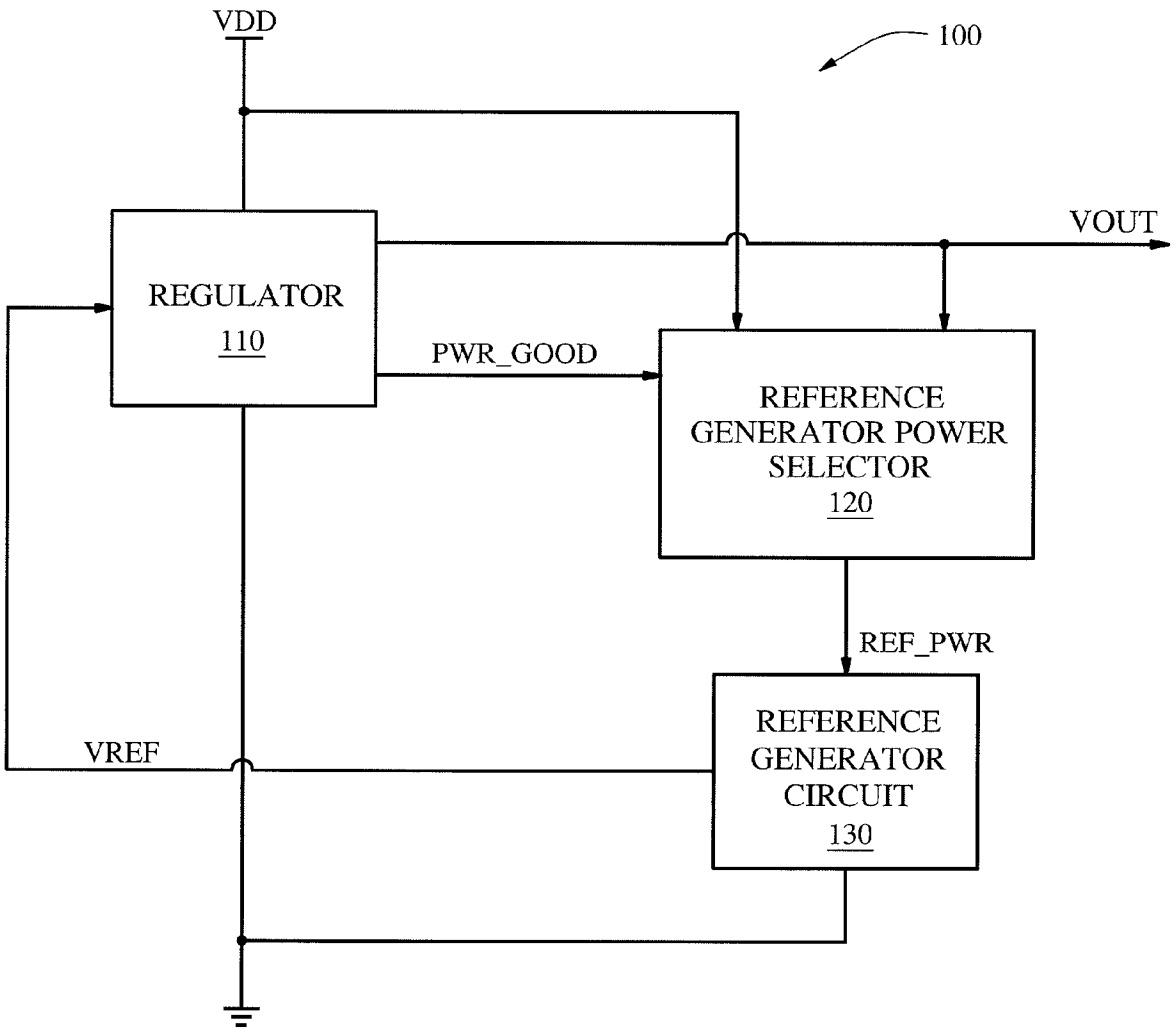
FIG. 1 is a block diagram of an embodiment of a regulator circuit according to aspects of the present invention.

FIG. 1 is a block diagram of an embodiment of single regulator circuit 100. Circuit 100 includes regulator 110, reference generator power selector 120, and reference generator circuit 130.

Circuit 100 is arranged to regulate regulated power signal VOUT to a substantially constant voltage over a range of input voltages of input power signal VDD. For example, circuit 100 may be arranged to regulate regulated power signal VOUT to +12 volts, +3.3 volts, +1.8 volts, −5 volts, and/or the like. In addition, circuit 100 is arranged as an improved PSRR regulation circuit. In particular, the PSRR of circuit 100 is improved by powering reference generator circuit 130 from a regulated power signal during steady state operation.

Regulator 110 is arranged to receive input power signal VDD and to receive reference signal VREF. Regulator 110 is further arranged to provide regulated power signal VOUT from input power signal VDD based, at least in part, on reference signal VREF. Regulator 110 is yet further arranged to provide status signal PWR_GOOD to indicate an operating condition of regulator 110.

As illustrated, regulator 110 is coupled to positive input power supply signal VDD and to ground. However, in other embodiments, regulator 110 may be coupled between a positive input power supply and a negative input power supply, between ground and a negative power supply, between two positive power supplies, and/or the like.

Reference generator power selector 120 is arranged to receive input power signal VDD, regulated power signal VOUT, and status signal PWR_GOOD. Reference generator power selector 120 is further arranged to power reference generator circuit 130 via reference generator circuit power signal REF_PWR. In one embodiment, reference generator circuit power signal REF_PWR is provided from one of input power signal VDD or regulated power signal VOUT. The selection between input power signal VDD and regulated power signal VOUT is based, at least in part, on status signal PWR_GOOD.

The noise on the reference signal VREF will generally be lower if reference generator circuit 130 is powered from regulated power signal VOUT instead of from input power signal VDD. In turn, reduced noise on reference signal VREF enables reduced noise and increased PSRR on regulated power signal VOUT.

However, if reference generator circuit 130 is powered directly from regulated power signal VOUT, the start-up time of circuit 100 may be relatively long. Circuit 100 start-up time is due, in part, to the delay between the availability of input power signal VDD and the availability of regulated power signal VOUT. For example, this delay is based, at least in part, on the start-up time of regulator 110, the load current draw, the start-up ramping of input power signal VDD, and/or the like. Accordingly, reference generator power selector 120 may be arranged to power reference generator circuit 130 from input power signal VDD during start-up and from regulated power signal VOUT during steady-state operation. Such "boot-strapping" enables reduced start-up time, while also enabling reduced steady-state noise on reference signal VREF. Accordingly, the PSRR on regulated power signal VOUT may be improved.

Figure 8:
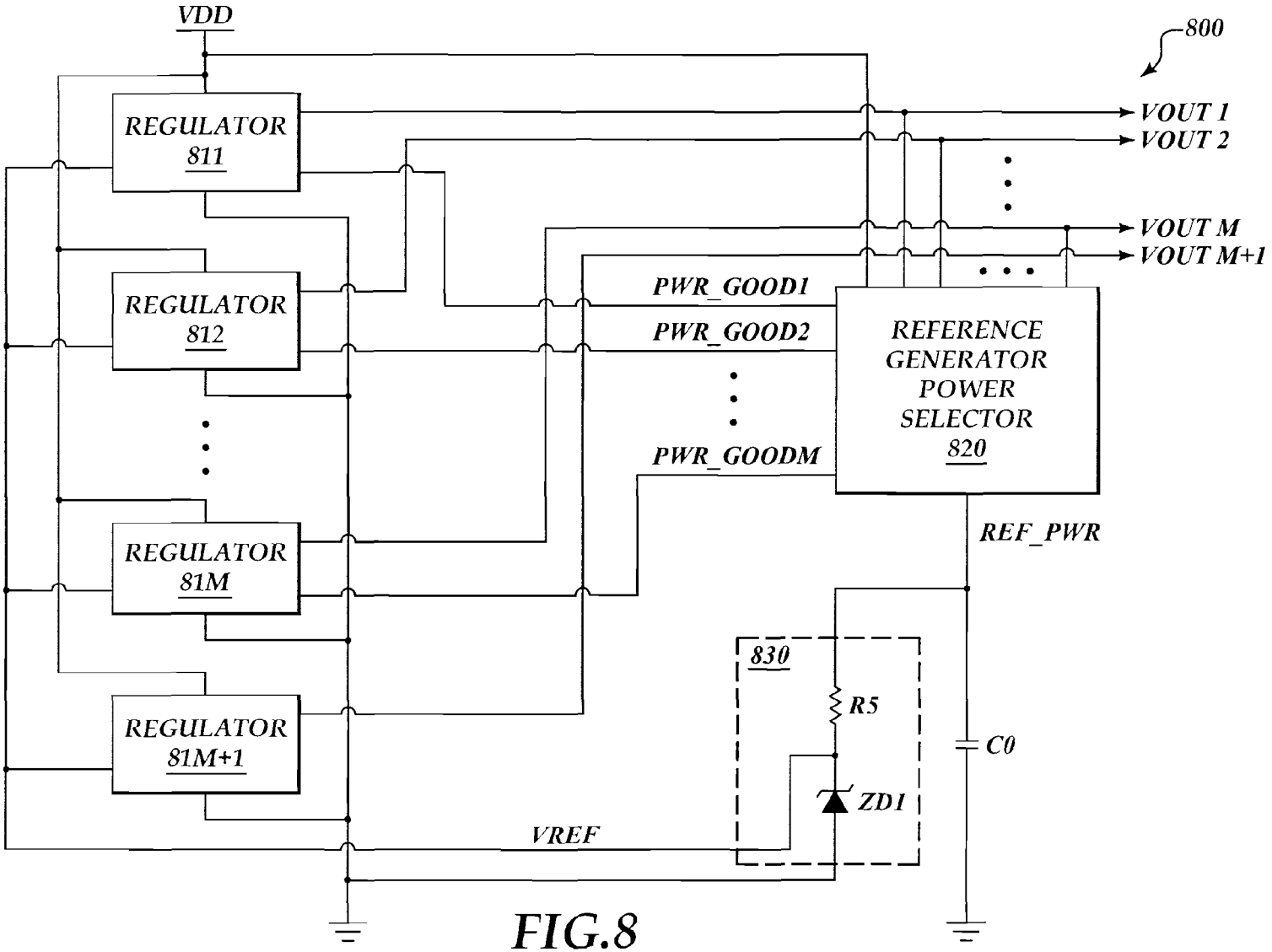
FIG. 8 is a block diagram of an embodiment of the regulator of FIG. 4 according to aspects of the present invention.
Figure 9:
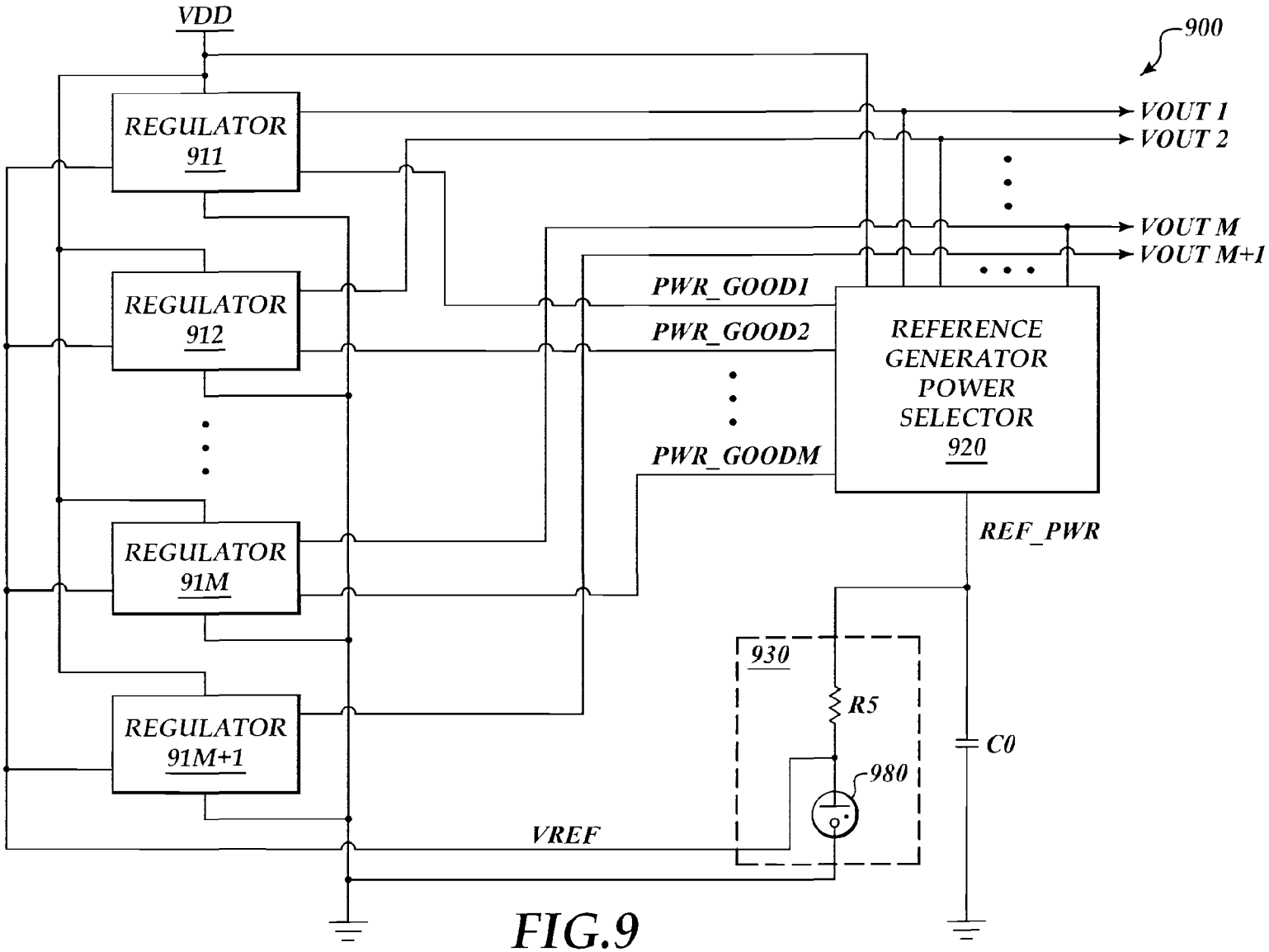
FIG. 9 is a block diagram of an embodiment of the regulator of FIG. 4 according to aspects of the present invention.
Figure 10:
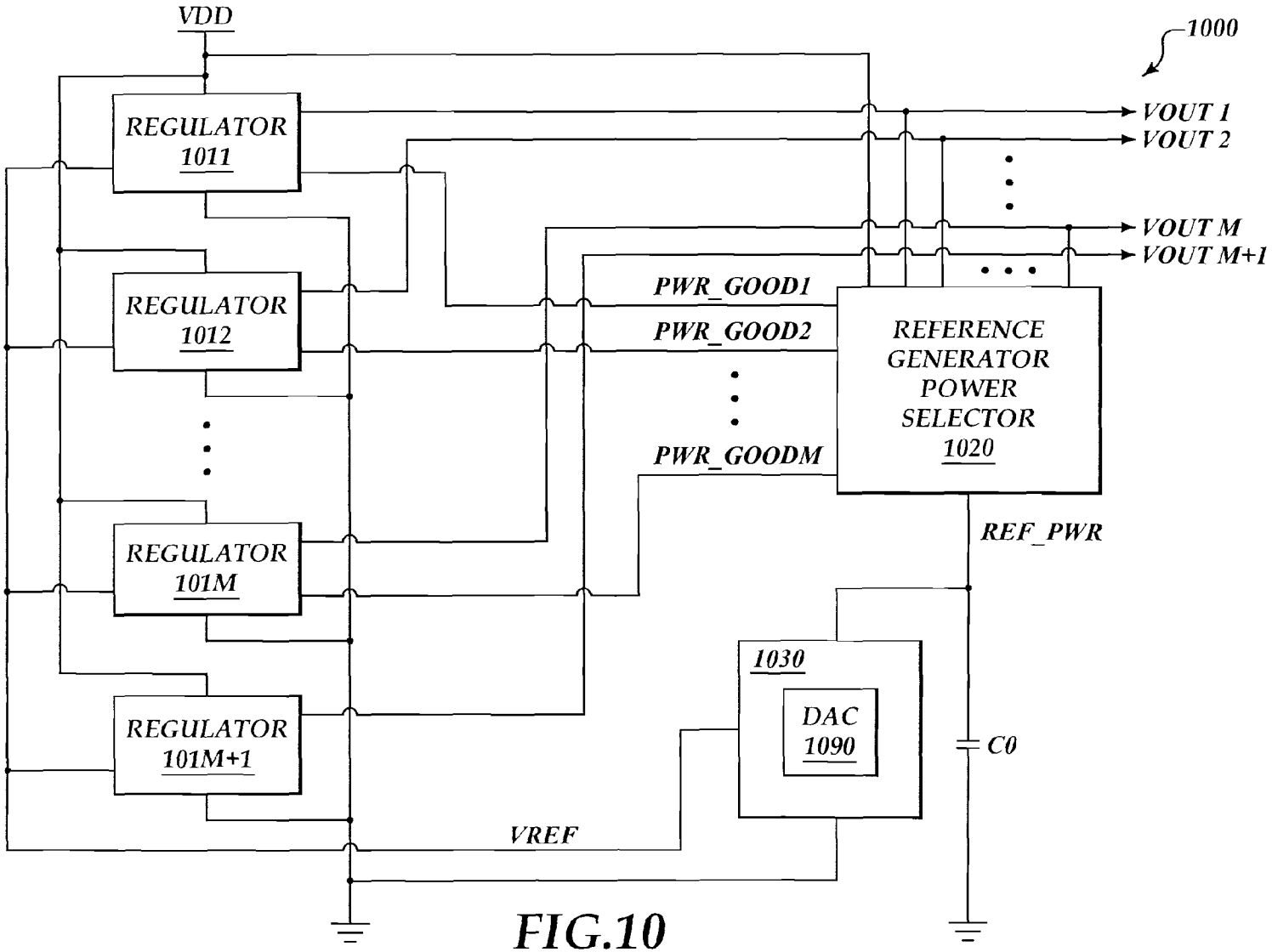
FIG. 10 is a block diagram of an embodiment of the regulator of FIG. 4 according to aspects of the present invention.

Reference generator circuit 130 is arranged to provide a substantially constant reference signal VREF. In one embodiment, reference generator circuit 130 includes a Brokaw band-gap reference circuit. In other embodiments, other band-gap circuits, linear regulators, Zener diodes (as shown in FIG. 8 according to one embodiment), gas-filled tubes (as shown in FIG. 9 according to one embodiment), digital-to-analog converters (as shown in FIG. 10 according to one embodiment), and/or the like, may be suitably employed in reference generator circuit 130 instead of, or in conjunction with, a Brokaw band-gap circuit.

Figure 7:
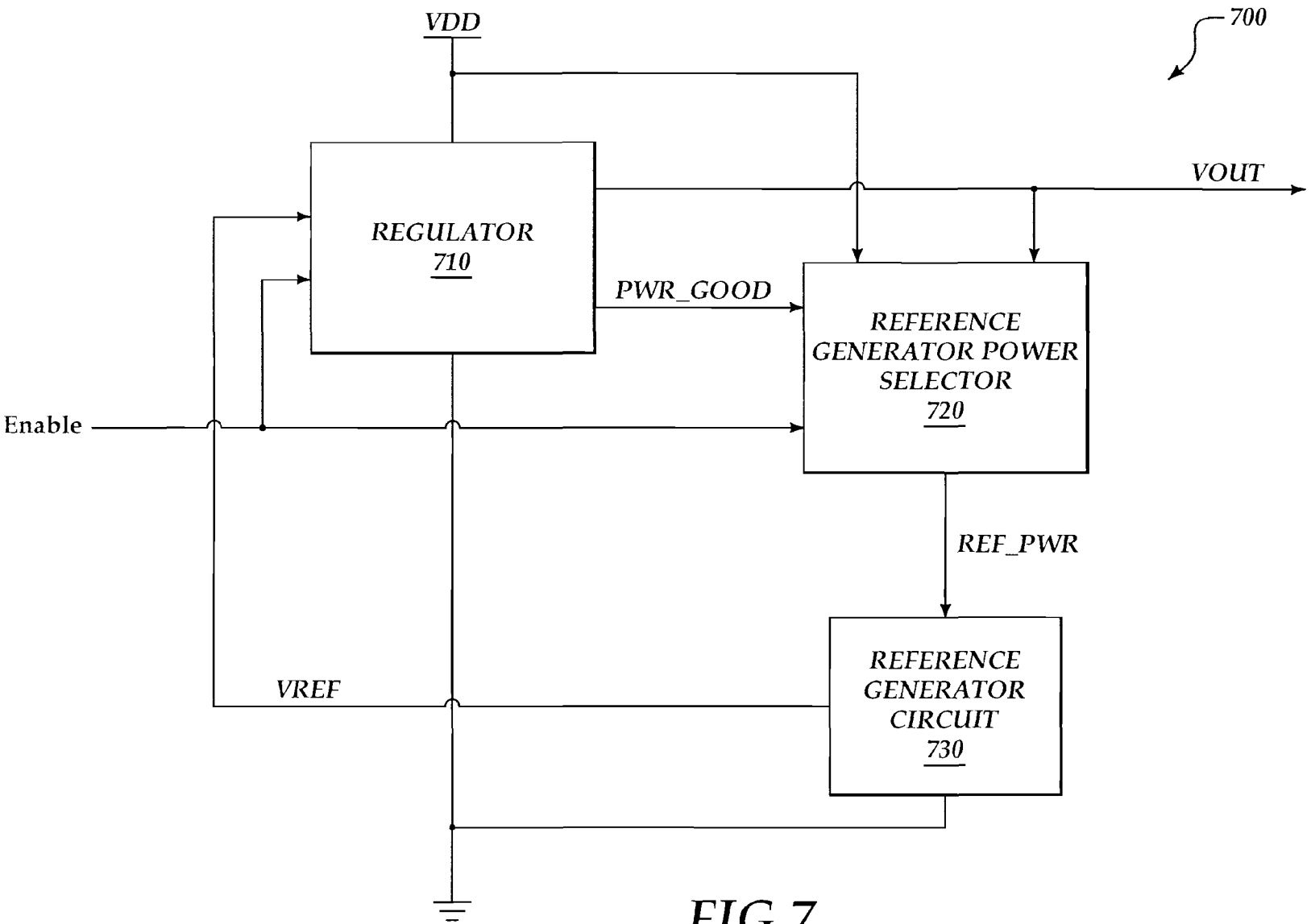
FIG. 7 is a block diagram of an embodiment of the regulator of FIG. 1 according to aspects of the present invention.

In other embodiments, circuit 100 differs from the described embodiments. For example, reference generator power selector 120 may be arranged to selectively power reference generator circuit 130 from other power signals, based on other criteria, and/or the like. Likewise, regulator 110 may be arranged to as a current regulator. In another embodiment, status signal PWR_GOOD may be provided by timer circuitry, power monitoring circuitry, user input, and/or the like. In addition, regulator 110 may be arranged to receive an enable signal, mode control signal, and/or the like, as shown in FIG. 7 in one embodiment. These and other variations are within the spirit and scope of the invention.

Figure 2:
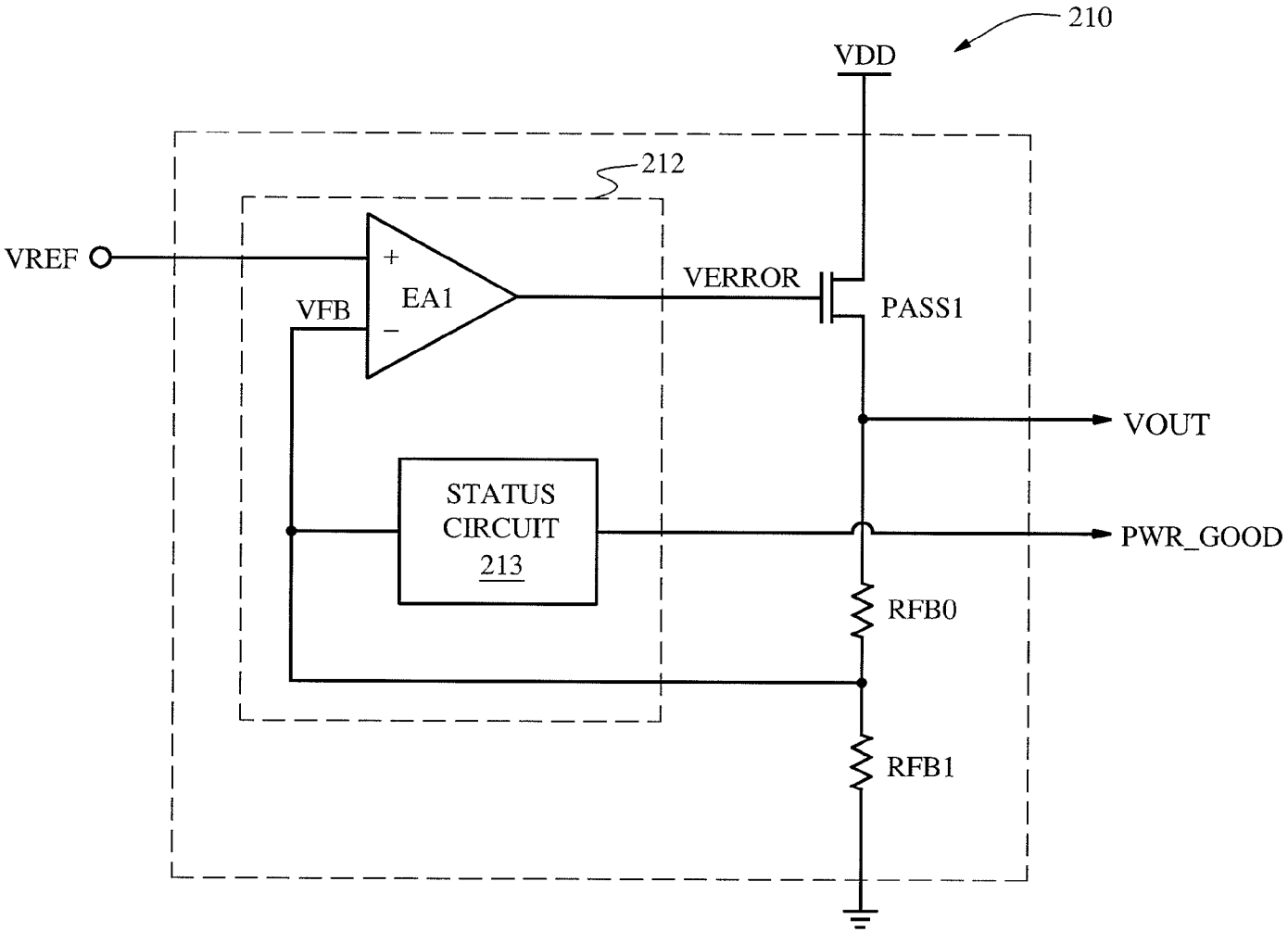
FIG. 2 is a block diagram of an embodiment of the regulator of FIG. 1 according to aspects of the present invention.

FIG. 2 is a block diagram of an embodiment of regulator 210. Regulator 210 includes regulator controller 212, pass circuit PASS1, and feedback voltage divider resistors RFB0 and RFB1. Regulator 210 may be employed as an embodiment of regulator 110 of FIG. 1.

Regulator 210 is arranged to receive input power signal VDD and reference voltage VREF. Regulator 210 is further arranged to provide regulated power signal VOUT from input power signal VDD based, at least in part, on reference signal VREF. Regulator 210 is yet further arranged to provide status signal PWR_GOOD to indicate an operating condition of regulator 210.

In one embodiment, regulator 210 is a low drop out (LDO) linear voltage regulator. However, virtually any other linear, low noise, and/or the like regulators, may be employed as regulator 210.

Regulator controller 212 includes error amplifier EA1 and status circuit 213. Error amplifier EA1 is arranged to control the conduction of pass circuit PASS1 based, at least in part, on a difference between reference signal VREF and feedback signal VFB. Regulator controller 212 may also include an under-voltage protection circuit; an over-voltage protection circuit, an over-current protection circuit; a temperature sensing circuit; and/or the like. (Not Shown).

Status circuit 213 is arranged to provide status signal PWR_GOOD to a reference generator power selector such as reference generator power selector 120 of FIG. 1. For example, in one embodiment, status signal PWR_GOOD is provided to indicate an operating condition of regulator 210. In one embodiment, status signal PWR_GOOD is deasserted (driven low) to indicate that the voltage of regulated power signal VOUT is below a threshold voltage, regulator 210 is in a start-up condition, regulated power signal VOUT is not substantially stable, and/or the like. Status signal PWR_GOOD may be asserted (driven high) to indicate that the voltage of regulated power signal VOUT is at or above a threshold voltage, regulator 210 is in a steady-state condition, regulated power signal VOUT is substantially stable, and/or the like. In other embodiments, the polarity of status signal PWR_GOOD may be reversed, status signal PWR_GOOD may be employed to indicate other operating conditions, and/or the like.

Pass circuit PASS1 is arranged to regulate regulated power signal VOUT by controlling the conduction of power from input power signal VDD based, at least in part, on error signal VERROR. In one embodiment, pass circuit PASS1 includes an N-channel MOSFET device. However, in other embodiments, pass circuit PASS1 may include a P-channel MOSFET device, a BJT transistor, a JFET transistor, and/or the like, instead of, or in addition to, an N-channel MOSFET device.

Feedback voltage divider resistors RFB0 and RFB1 are arranged to receive regulated power signal VOUT and to provide feedback signal VFB to error amplifier EA1. The values of resistors RFB0 and RFB1 may be selected to regulate the voltage of regulated power signal VOUT to any value. In other embodiments, a reference signal voltage divider, a reference signal amplifier circuit, a feedback signal amplifier circuit, and/or the like, may be suitably employed to provide similar functionality. In yet another embodiment, feedback signal VFB is provided directly from regulated power signal VOUT.

Figure 3:
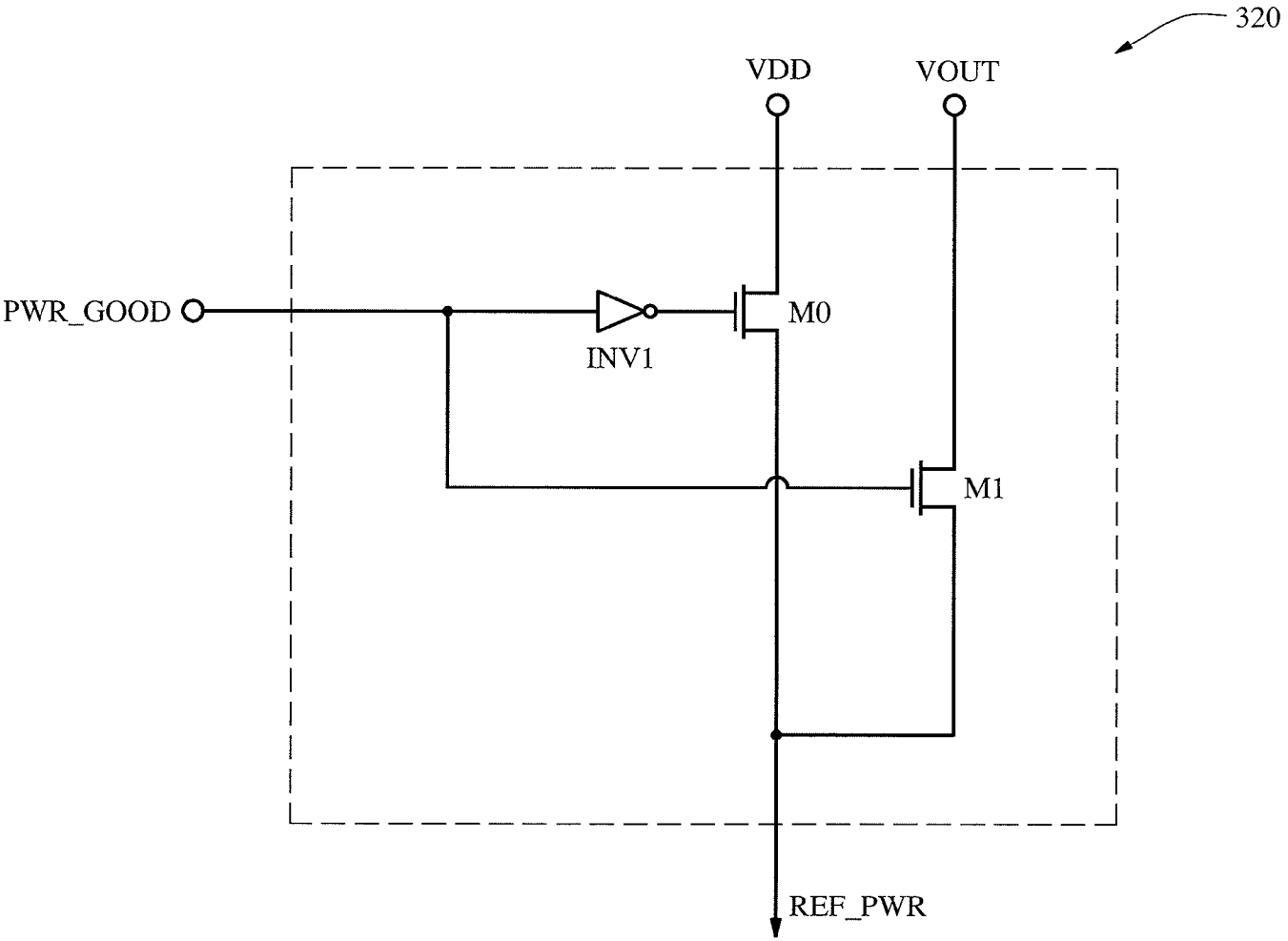
FIG. 3 is a schematic diagram of an embodiment of the reference generator power selector of FIG. 1 according to aspects of the present invention.

FIG. 3 is a schematic diagram of an embodiment of reference generator power selector 320. Reference generator power selector 320 includes inverter INV1, transistor M0, and transistor M1. Reference generator power selector 320 may be employed as an embodiment of reference generator power selector 120 of FIG. 1.

Reference generator power selector 320 is arranged to selectively couple one of input power signal VDD or regulated power signal VOUT to reference generator circuit power signal REF_PWR based, at least in part, on status signal PWR_GOOD. For example, reference generator circuit power signal REF_PWR may be employed to power a reference generator circuit such as reference generator circuit 130 of FIG. 1.

Transistors M0 and M1 may be any type of transistors. In one embodiment, transistors M0 and M1 are N-channel MOSFET devices. However, in other embodiments, transistors M0 and M1 may be P-channel MOSFET devices, BJT transistors, JFET transistors, and/or the like. In yet other embodiments, other electronically controlled switching devices such as relays, double pole switches, and/or the like, may be employed instead of transistors M0 and M1.

In one embodiment, status signal PWR_GOOD is an active high signal. In this example, reference generator power selector 320 is arranged such that regulated power signal VOUT is coupled to reference generator circuit power signal REF_PWR while status signal PWR_GOOD is high. Likewise, input power signal VDD is coupled to reference generator circuit power signal REF_PWR while status signal PWR_GOOD is low. In other embodiments, status signal PWR_GOOD may be an active low signal, may include more than one status or control signals, and/or the like. These and other variations are within the spirit and scope of the invention.

Figure 4:
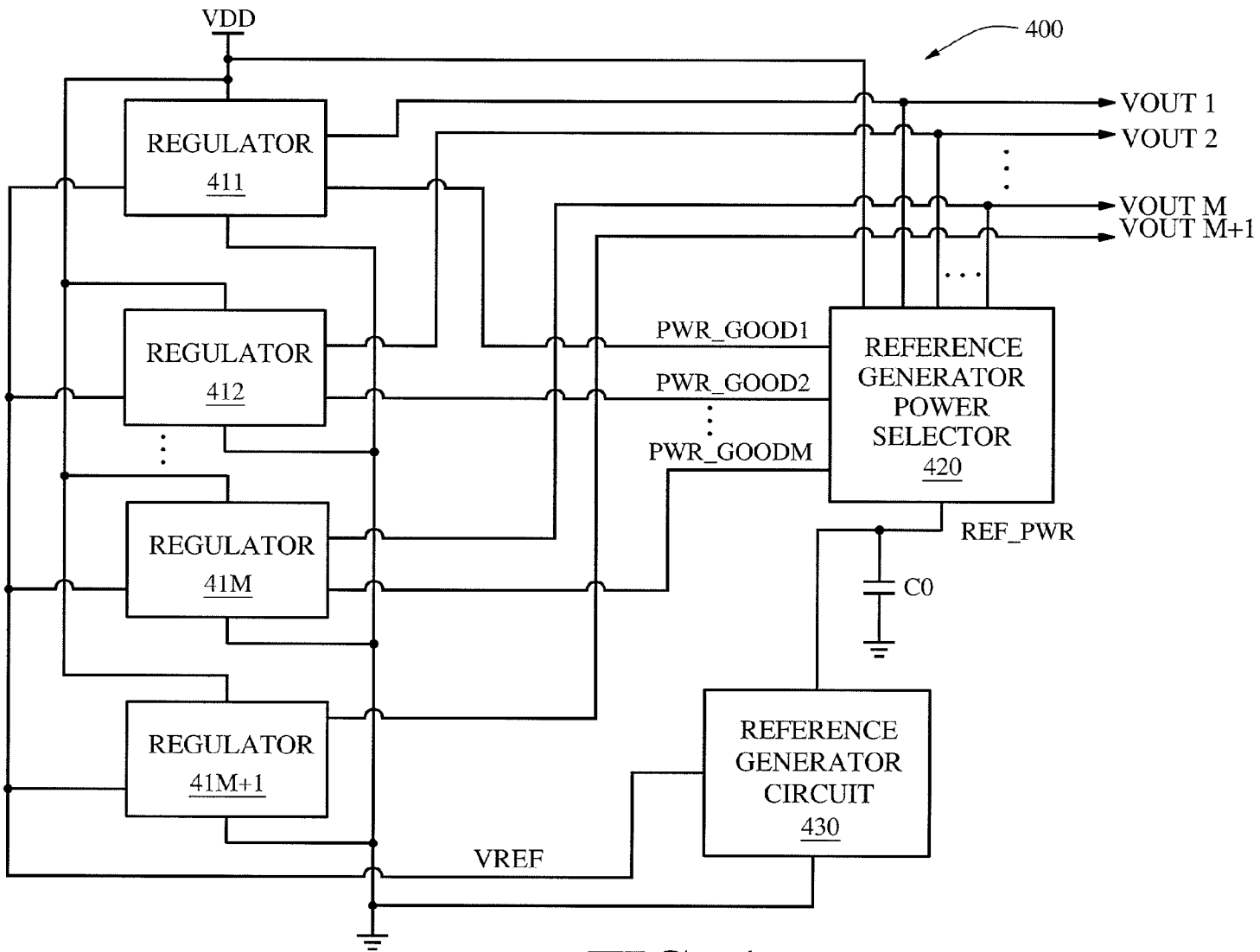
FIG. 4 is a block diagram of another embodiment of the regulator circuit of FIG. 1 according to aspects of the present invention.

FIG. 4 is a block diagram of an embodiment of multiple regulator circuit 400. Circuit 400 includes regulators 411-41*m*+1, reference generator power selector 420, reference generator circuit 430, and capacitor C0.

Regulators 411-41*m* are each arranged to receive input power signal VDD and to receive reference signal VREF. Each of regulators 411-41*m* is respectively arranged to provide regulated power signal VOUT1-VOUTm and status signals PWR_GOOD1-PWR_GOODm from input power signal VDD based, at least in part, on reference signal VREF. Regulators 411-41*m* may each be employed as an embodiment of regulator 110 of FIG. 1 or of regulator 210 of FIG. 2.

Regulator 41*m*+1 is arranged to receive input power signal VDD, to receive reference signal VREF, and to provide output power signal VOUTm+1. Regulator 41*m*+1 may be virtually any regulator that is arranged to receive a reference signal. For example, it may be a linear regulator, a switching regulator, and/or the like. Regulator 41*m*+1 may also include buck regulation circuitry, buck-boost regulation circuitry, inverting regulation circuitry, fly-back conversion circuitry, and/or the like, and may include synchronous or asynchronous rectification circuitry. Further, regulator 41*m*+1 may include pulse width modulation (PWM), pulse frequency modulation (PFM), hysteretic, constant-on-time, and/or the like, regulation circuitry. In addition, regulator 41*m*+1 may also include linear, a low dropout, and/or the like, regulation circuitry.

Reference generator power selector 420 is arranged to selectively couple one of input power signals VDD or regulated power signals VOUT1-VOUTm to reference generator circuit power signal REF_PWR based, at least in part, on status signals PWR_GOOD1-PWR_GOODm. Reference generator power selector 420 is discussed in further detail with respect to FIG. 5, for one embodiment.

Capacitor C0 is arranged as a bypass capacitor to further smooth the power provided to reference generator 430. Capacitor C0 may be of any suitable type or value.

Reference generator circuit 430 may be employed as an embodiment of reference generator circuit 130 of FIG. 1.

Figure 5:
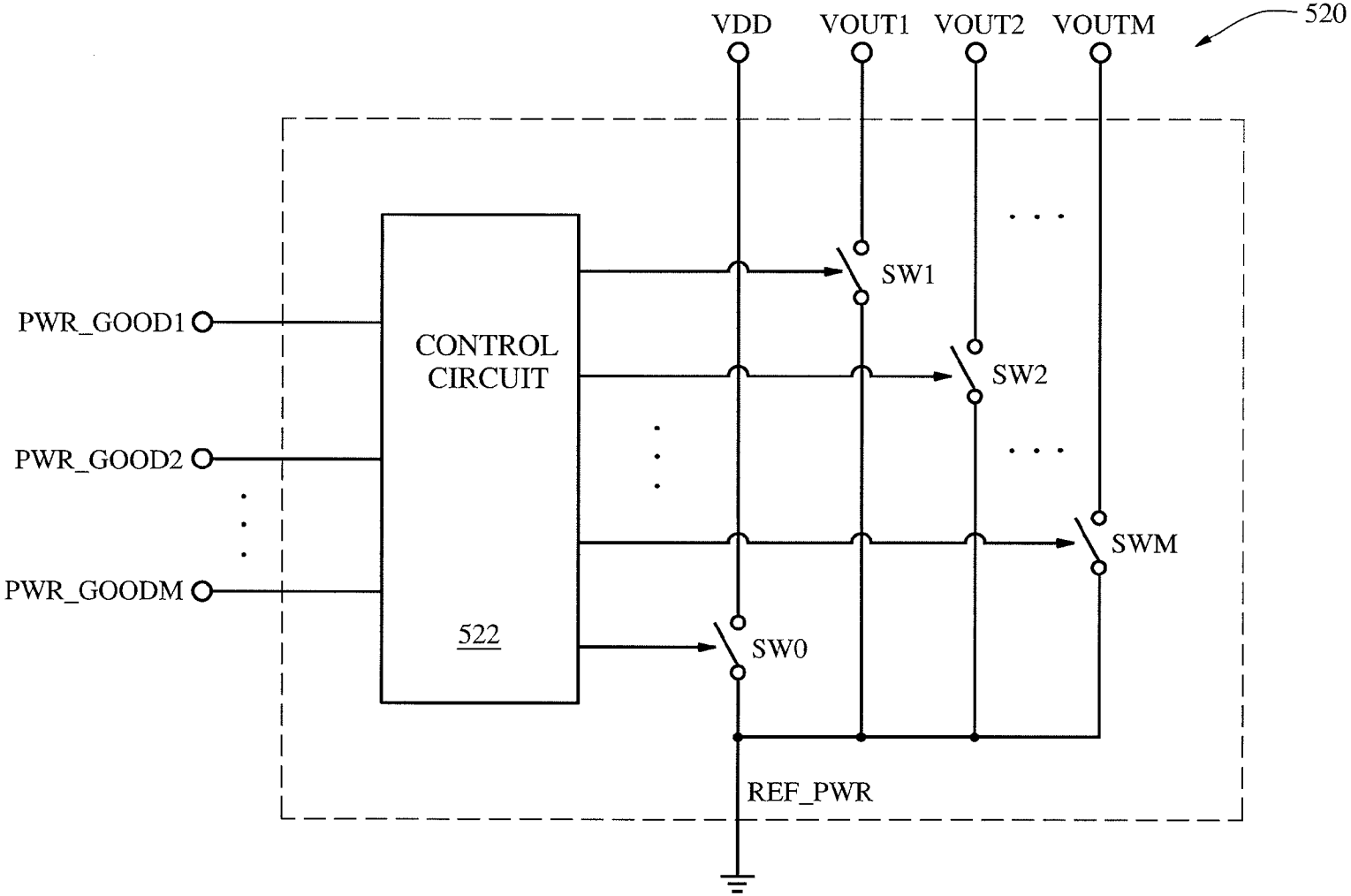
FIG. 5 is a schematic diagram of another embodiment of the reference generator power selector of FIG. 4 according to aspects of the present invention.

FIG. 5 is a schematic diagram of an embodiment of reference generator power selector 520. Reference generator power selector 520 includes control circuit 522 and switches SW0-SWm. Reference generator power selector 520 may be employed as an embodiment of reference generator power selector 420 of FIG. 4.

Reference generator power selector 520 is arranged to selectively couple one of input power signal VDD or regulated power signals VOUT1-VOUTm to reference generator circuit power signal REF_PWR based, at least in part, on status signals PWR_GOOD1-PWR_GOODm.

Control circuit 522 is arranged to receive status signals PWR_GOOD1-PWR_GOODm and to provide switch control signals to switches SW1-SWm. In one embodiment, control circuit 522 is arranged to control the selective steady-state powering of a reference generator circuit from the regulated power signal which corresponds to first asserted status signal. However, in other embodiments, control circuit 522 may be arranged to perform steady-state selection of power signals VOUT1-VOUTm in other ways. For example, control circuit 522 may select the most stable power signal, may randomly select a power signal, and/or the like. In one embodiment, control circuit 522 is arranged to select a power signal based on an associated enable signal. Accordingly, in some embodiments, control circuit 522, which is part of reference generator power selector 520, receives an enable signal. FIG. 7 shows an example of one embodiment of a reference generator power selector that receives the enable signal.

Control circuit 522 may include make-before-break logic, break-before-make logic, combinatorial logic, state-machines, micro-processors, micro-controllers, and/or the like.

Switches SW1-SWm may be any type of switches or switching devices. For example, switches SW1-SWm may include N-channel MOSFET devices, P-channel MOSFET devices, BJT transistors, JFET transistors, relays, and/or the like.

Figure 6:
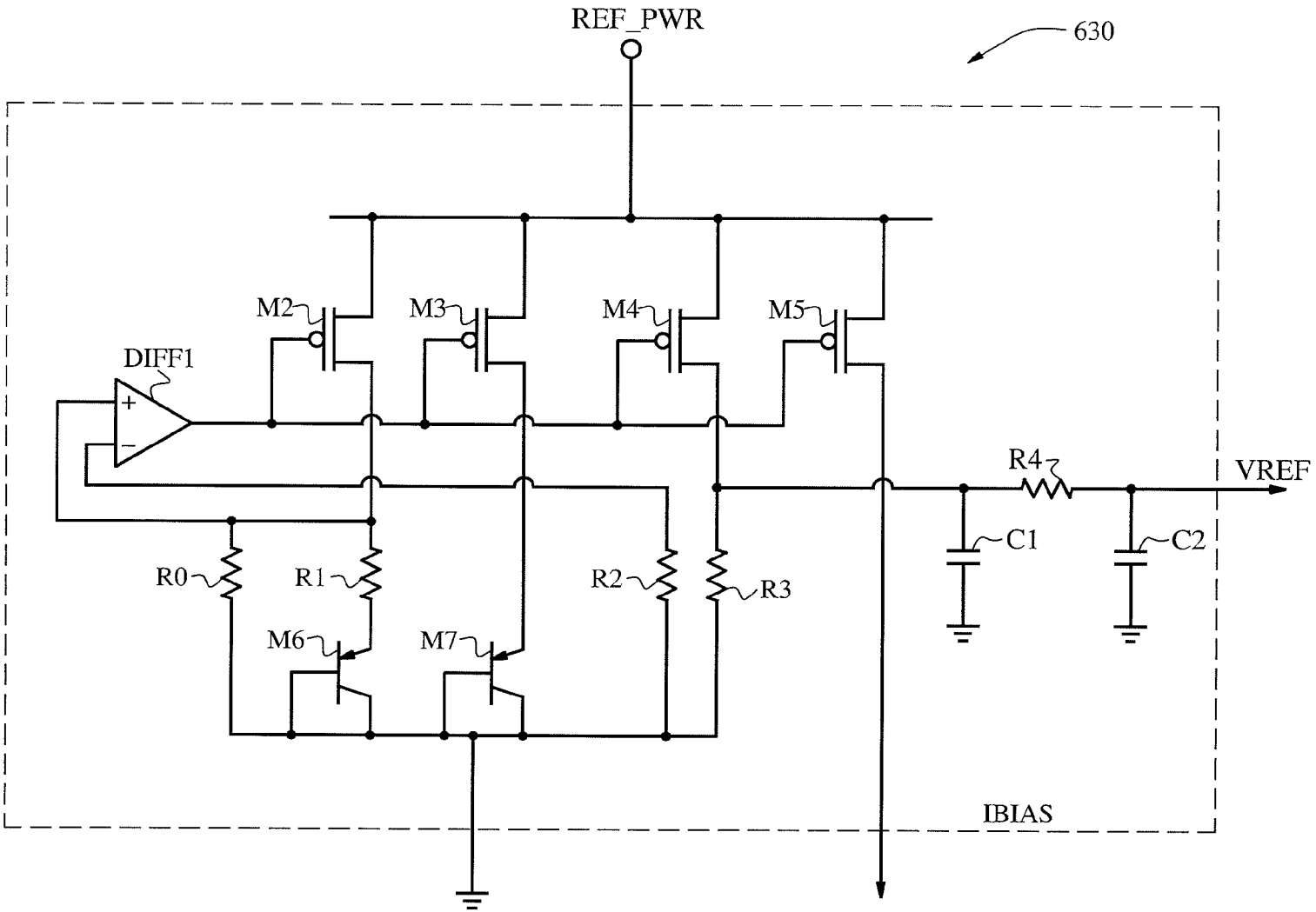
FIG. 6 is a schematic diagram of an embodiment of the reference generator circuit of FIG. 1 according to aspects of the present invention.

FIG. 6 is a schematic diagram of an embodiment of reference generator circuit 630. Reference generator circuit 630 includes differential amplifier DIFF1, transistors M2-M7, resistors R0-R4, and capacitors C1 and C2. Reference generator circuit 630 may be employed as an embodiment of reference generator circuit 130 of FIG. 1 or as an embodiment of reference generator circuit 430 of FIG. 4.

In one embodiment, reference generator circuit 630 is arranged as a band-gap reference circuit with an integrated RC π low-pass filter. Also, reference generator circuit 630 is further arranged to provide central bias current IBIAS. For example, central bias current IBIAS may be provided to one or more regulators and may be of any suitable value.

Although reference generator circuit 630 is depicted as a band-gap reference circuit, the invention is not limited in this manner. In other embodiments, linear regulators, Zener diodes, gas-filled tubes, digital-to-analog converters, and/or the like, may also be suitably employed in reference generator circuit 630.

FIG. 7 is a block diagram of an embodiment of regulator 700, which may be employed as an embodiment of regulator 100 of FIG. 1. In regulator 700, regulator 710 and reference generator power selector 720 each receive enable signal Enable.

FIG. 8 is a block diagram of an embodiment of regulator 800, which may be employed as an embodiment of regulator 400 of FIG. 4. Reference generator circuit 830 includes resistor R5 and Zener diode ZD1.

FIG. 9 is a block diagram of an embodiment of regulator 900, which may be employed as an embodiment of regulator 400 of FIG. 4. Reference generator circuit 930 includes resistor R5 and gas-filled tube 980.

FIG. 10 is a block diagram of an embodiment of regulator 1000, which may be employed as an embodiment of regulator 400 of FIG. 4. Reference generator circuit 930 includes digital-to-analog converter (DAC) 990.

The above specification, examples and data provide a description of the method and applications, and use of the invention. Since many embodiments of the invention can be made without departing from the spirit and scope of the invention, this specification merely set forth some of the many possible embodiments for the invention.

What is claimed as new and desired to be protected by Letters Patent of the United States is:

1. A circuit for regulating power, comprising:

a regulator that is arranged to receive an input power signal, to receive a reference signal, and to provide a regulated power signal; and is further arranged such that the regulated power signal is provided based, at least in part, on the reference signal;

a reference generator circuit that is arranged to provide the reference signal such that the reference signal is maintained at a substantially constant value, wherein the reference generator circuit includes a band-gap reference circuit; and a reference generator power selector that is arranged to selectively power the reference generator circuit from one of a plurality of power signals, wherein the plurality of power signals includes the input power signal and the regulated power signal.

2. The circuit of claim 1, wherein the regulator is further arranged to provide a status signal such that the status signal is based, at least in part, on an operating condition of the regulator, wherein the reference generator power selector is further arranged to receive the status signal and to selectively power the reference generator circuit from one of a plurality of power signals based, at least in part, on the status signal.

3. The circuit of claim 1, wherein the reference generator power selector is further arranged to power the reference generator circuit from the input power signal during a start-up condition, and from the regulated power signal during a steady-state condition.

4. The circuit of claim 1, wherein the regulator and the reference generator power selector are further arranged to receive an enable signal, and wherein the reference generator power selector is further arranged to receive a status signal, and is arranged to selectively power the reference generator circuit from one of the plurality of power signals based, at least in part, on the enable signal.

5. The circuit of claim 1, wherein the reference generator power selector enables reduced start-up delay and an improved power supply reduction ratio (PSRR).

6. The circuit of claim 1, wherein the reference generator power selector enables reduced steady state reference signal noise.

7. The circuit of claim 1, wherein the band-gap reference circuit includes:

a Brokaw band-gap reference that is arranged to provide an unfiltered reference signal; and a low pass filter circuit that is arranged to receive the unfiltered reference signal, to low-pass filter the unfiltered reference signal, and to provide the reference signal.

8. The circuit of claim 1, further comprising another regulator that is arranged to receive the reference signal and to provide another regulated power supply signal that is based, at least in part, on the reference signal, wherein the plurality of power signals further includes said another regulated power supply signal.

9. The circuit of claim 8, wherein said another regulator is a low drop out linear regulator.

10. The circuit of claim 8, further comprising a switched mode regulator that is arranged to receive the input power signal, to receive the reference signal, and to provide another output power signal that is based, at least in part, on the reference signal.

11. A circuit for regulating power, comprising:

a regulator controller that is arranged to receive an input power signal, to receive a reference signal, and to receive a regulated power signal; and is further arranged to control the regulated power signal based, at least in part, on the reference signal;

a reference generator circuit that is arranged to provide the reference signal such that the reference signal is maintained at a substantially constant value; and a reference generator power selector that is arranged to selectively power the reference generator circuit from one of a plurality of power signals, wherein the plurality of power signals includes the input power signal and the regulated power signal.

12. The circuit of claim 11, wherein the reference generator power selector is further arranged to receive a status signal and to selectively power the reference generator circuit from one of a plurality of power signals based, at least in part, on the status signal, wherein the status signal is based, at least in part, on an operating condition.

13. The circuit of claim 11, wherein the reference generator power selector is further arranged to power the reference generator circuit from the input power signal during a start-up condition, and from the regulated power signal during a steady-state condition.

14. The circuit of claim 11, wherein the reference generator power selector enables reduced start-up delay and an improved power supply reduction ratio (PSRR).

15. The circuit of claim 11, wherein the reference generator circuit includes at least one of a band-gap reference circuit, a Zener diode, a gas filled tube, or a digital-to-analog converter.

16. The circuit of claim 11, wherein the reference generator circuit includes:

a Brokaw band-gap reference that is arranged to provide an unfiltered reference signal; and a low pass filter circuit that is arranged to receive the unfiltered reference signal, to low-pass filter the unfiltered reference signal, and to provide the reference signal.

17. The circuit of claim 11, further comprising another regulator that is arranged, to receive the reference signal, and to provide another regulated power signal based, at least in part, on the reference signal, wherein the plurality of power signals further includes said another regulated power signal.

18. A method for regulating power, comprising:

receiving an input power signal;

employing a reference generator circuit to provide a reference signal, wherein the reference signal is maintained at a substantially constant value;

regulating a regulated power signal based, at least in part, on the input power signal and the reference signal;

powering, during a first operating condition, the reference generator circuit from the input power signal; and powering, during a second operating condition, the reference generator circuit from the regulated power signal.

19. The method of claim 18, wherein reduced start-up delay and an improved power supply reduction ratio (PSRR) are enabled.

20. The method of claim 18, wherein the first operating condition corresponds to a start-up condition, and wherein the second operating condition corresponds to a steady-state condition.

* * * * *

UNITED STATES PATENT AND TRADEMARK OFFICE

CERTIFICATE OF CORRECTION

PATENT NO. : 7,804,284 B1
APPLICATION NO. : 11/871518
DATED : September 28, 2010
INVENTOR(S) : Kern Wai Wong It is certified that error appears in the above-identified patent and that said Letters Patent is hereby corrected as shown below:

On the Title page, in Item (56), under "Other Publications", line 4, delete "Hish" and insert -- High --, therefor.

Signed and Sealed this
Twenty-sixth Day of April, 2011

David J. Kappos

David J. Kappos
*Director of the United States Patent and Trademark Office*